US006568453B2

(12) United States Patent
Zorbas

(10) Patent No.: US 6,568,453 B2
(45) Date of Patent: May 27, 2003

(54) PLEATED BLIND

(75) Inventor: Tass Zorbas, Bedfordale (AU)

(73) Assignee: Mardo Australia Pty Ltd, Jandakot (AU)

( * ) Notice: Subject to any disclaimer, the term of this patent is extended or adjusted under 35 U.S.C. 154(b) by 0 days.

(21) Appl. No.: 09/919,203

(22) Filed: Jul. 31, 2001

(65) Prior Publication Data

US 2002/0043346 A1 Apr. 18, 2002

(51) Int. Cl.[7] ..... E06B 9/06
(52) U.S. Cl. ..... 160/84.05
(58) Field of Search ..... 160/84.05, 84.04, 160/236, 84.01; 156/296, 291, 148; 428/116, 188

(56) References Cited

U.S. PATENT DOCUMENTS 3,086,753 A * 4/1963 Cushman
RE31,129 E * 1/1983 Rasmussen
4,412,880 A * 11/1983 Wintermantel
5,701,940 A * 12/1997 Ford et al.
6,206,075 B1 * 3/2001 Prince et al.

FOREIGN PATENT DOCUMENTS

BE A 634317 * 6/1963

* cited by examiner

*Primary Examiner*—Blair M. Johnson
(74) *Attorney, Agent, or Firm*—Bachman & LaPointe, P.C.

(57) ABSTRACT

A pleated blind having a plurality of flexible tubular fabric slats connected together in side by side relationship. The slats may be adhered together by any suitable means. The slats may be flattened and then allowed to expand under the influence of gravity.

8 Claims, 2 Drawing Sheets

PLEATED BLIND

CROSS REFERENCE TO RELATED APPLICATION

This application is related to U.S. Disclosure Document No. 470,629 filed Sep. 11, 2000 with the U.S. Patent and Trademark Office.

FIELD OF INVENTION

The present invention relates to a pleated blind.

BRIEF DESCRIPTION OF THE INVENTION

In accordance with one aspect of the present invention there is provided a pleated blind comprising a plurality of flexible tubular fabric slats in which adjacent slats are connected together contiguously in side by side relationship.

BRIEF DESCRIPTION OF THE DRAWINGS

The present invention will now be described, by way of example, with reference to the accompanying drawings, in which.

DESCRIPTION OF THE INVENTION

Figure 1:
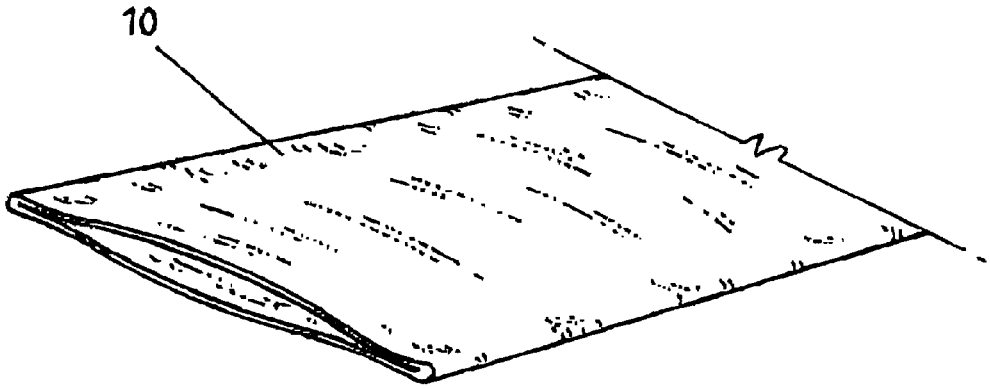
FIG. 1 is an upper perspective view of part of a fabric tube slat used to manufacture a pleated blind in accordance with the present invention.

In FIG. 1 of the drawings, there is shown part of a flexible fabric tube slat 10 formed of a woven fabric material. Further, the fabric tube slat 10 may be fabricated from yarn on a narrow weaving loom. The fabric material is preferably polyester fabric produced from polyester yarn. The fabric tube slat 10 as seen in FIG. 1 has an endless periphery and does not contain any longitudinal joints.

Figure 2:
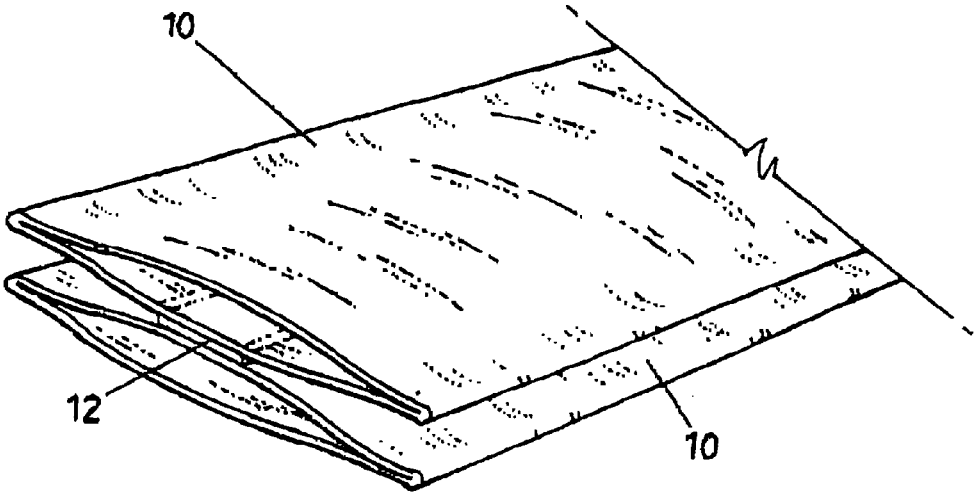
FIG. 2 is an upper perspective view similar to FIG. 2 showing two of the fabric tube slats adhered together.

As can be seen in FIG. 2, in accordance with the present invention, adjacent fabric tube slats 10 are adhered together in contiguous side by side relationship such as by means of adhesive tapes 12.

Further, fabric tubes from the weaving loom are preferably coated with a non-stick coating such as an acrylic coating. The non-stick coating has the advantage of preventing the fabric tube slats 10 from sticking to one another inadvertently and also assists in prevention of fraying of ends of the fabric tube slats 10 if the fabric tube slats 10 are cut during fabrication. Also, it is envisaged that the fabric tube slats 10 would be formed with holes such as by punching or drilling to accommodate cords from which a blind is suspended in use. The non-stick coating helps prevent fraying of these holes.

Preferably, the fabric tube is initially produced in elongated form from the weaving loom and then cut to length as required to form the fabric tube slats 10.

The fabric tube may be finished using a narrow coating or finishing line which may involve various steps such as dipping of the fabric tube in a bath of coating material and then drying and callandering. The finished elongated fabric tube is typically then formed into a roll in which the fabric tube is in flattened form.

Subsequently, the fabric tube 10 is provided with adhesive means which may be in the form of double sided adhesive tape 12 shown in FIG. 2. The double sided adhesive tape 12 may be applied externally to a fabric tube at two opposed locations with one side of the tape 12 protected to avoid inadvertent sticking of the tape 12. The double sided tape 12 will be of a width smaller than the flattened fabric tube. For example, a flattened fabric tube which is about 50 mm wide may require an adhesive tape which is from 3 to 10 mm wide such as about 5 mm wide.

Double sided adhesive tapes 12 may be applied in a suitable apparatus to the centre of the flattened fabric tube from the roll both top and bottom in opposed locations. Subsequently, the fabric tube and the tapes may be guided through a station where they are passed through, for example, pressure rollers so that a strong bond is formed between the tapes 12 and the fabric tube 10.

Figure 3:
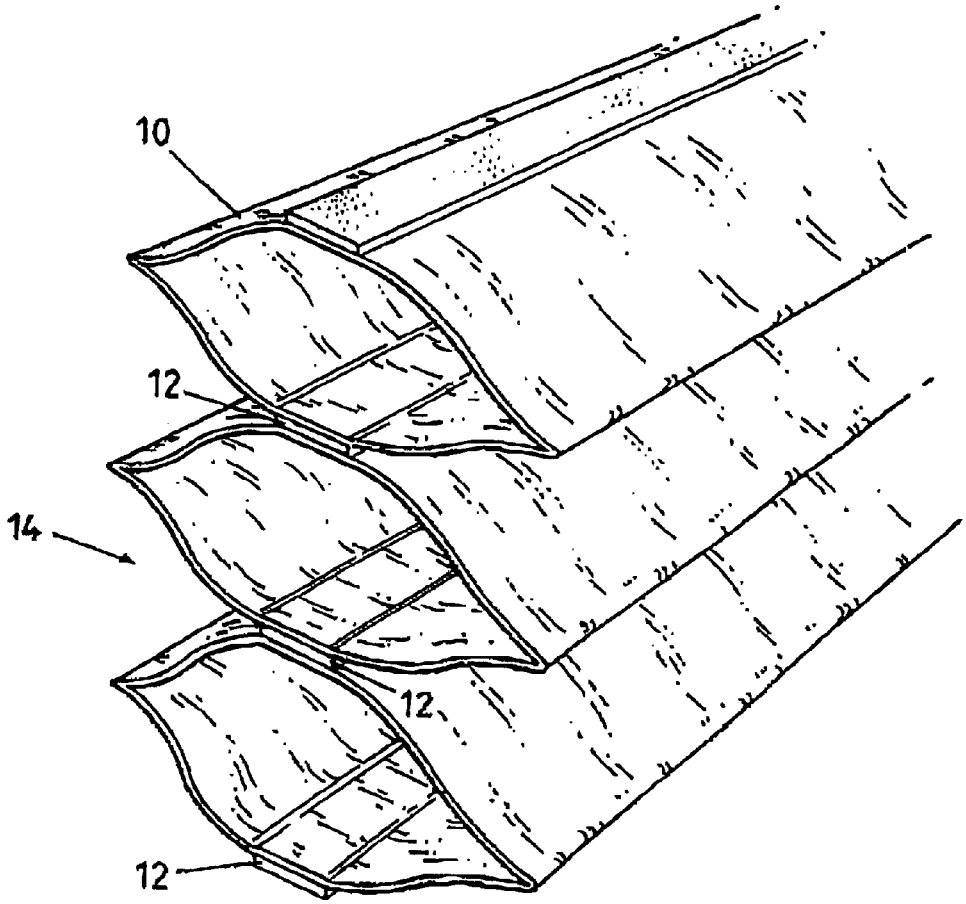
FIG. 3 is an end view of a pleated blind in accordance with the present invention made from the fabric blind slats of FIGS. 1 and 2 in expanded condition.

To form a pleated blind 14 as shown in FIG. 3, the fabric tube with tapes 12 is cut into desired lengths to form the flexible fabric tube slats 10. A protective covering is removed from each tape 12. Then a tape 12 of a similar type is pressed into engagement with the first mentioned blind slat 10 so that two blind slats 10 may be adhered together by means of the adhesive tapes 12. This process is repeated until the desired blind size is achieved. The pleated blind 14 can be finished off by means known in the art.

It is envisaged that the pleated blind 14 will be sold in a roll with the fabric tube slats 10 in flattened form. The user will then form the blind 14 into the finished product to suit a particular application. In use the plated blind 14 is suspended and allowed to expand as shown in FIG. 3 so as to enable it to cover a window or door opening as the like.

The adhesive tapes described hereinbefore can be replaced by alternative adhering means such as ultrasonic welding, heat fusion, ultraviolet stitcking, adhesives, heat sensitive tapes or any other suitable means for sticking two slats 10 together.

Modifications and variations such as would be apparent to a skilled addressee are deemed within the scope of the present invention.

What is claimed is:

1. A pleated blind comprising a plurality of flexible tubular slats each formed of fabric material woven from yarn on a narrow weaving loom, the tubular slats each having an endless periphery and not containing any longitudinal joints, and adjacent slats being connected together contiguously in side by side relationship.

2. A pleated blind according to claim 1, wherein the adjacent slats are adhered together.

3. A pleated blind according to claim 2, wherein the adjacent slats are adhered together by means of adhesive tape.

4. A pleated blind according to claim 3, wherein the width of the adhesive tape is in the range from 3 to 10 mm.

5. A pleated blind according to claim 4, wherein the width of the adhesive tape is about 5 mm.

6. A pleated blind according to claim 1, wherein the flexible tubular slats are formed of polyester fabric.

7. A pleated blind according to claim 1, wherein the pleated blind is able to be suspended and to expand under the influence of gravity.

8. A pleated blind according to claim 1, wherein the tubular slats are coated with a non-stick coating.

* * * * *

UNITED STATES PATENT AND TRADEMARK OFFICE

CERTIFICATE OF CORRECTION

PATENT NO. : 6,568,453 B2
DATED : May 27, 2003
INVENTOR(S) : Tass Zorbas

It is certified that error appears in the above-identified patent and that said Letters Patent is hereby corrected as shown below:

Column 2,
Line 46, after the word "having" -- an outer and an inner surface and -- should be inserted.
Line 47, after the word "joints," -- the inner surface defining a substantially hollow interior -- should be inserted.

Signed and Sealed this

Eighteenth Day of November, 2003

JAMES E. ROGAN
*Director of the United States Patent and Trademark Office*